US009086247B2

(12) United States Patent
Lessard

(10) Patent No.: US 9,086,247 B2
(45) Date of Patent: Jul. 21, 2015

(54) HINGE PIN CONNECTOR

(71) Applicant: Sig Sauer, Inc., Newington, NH (US)

(72) Inventor: Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/153,981

(22) Filed: Jan. 13, 2014

(65) Prior Publication Data

US 2014/0196338 A1 Jul. 17, 2014

Related U.S. Application Data

(60) Provisional application No. 61/751,500, filed on Jan. 11, 2013.

(51) Int. Cl.
*F41A 35/02* (2006.01)
*F41A 3/66* (2006.01)

(52) U.S. Cl.
CPC . *F41A 3/66* (2013.01); *F41A 35/02* (2013.01); *Y10T 29/49826* (2015.01)

(58) Field of Classification Search
USPC ..... 42/73, 71.01, 72, 75.01, 75.02, 75.03, 42/46, 47, 106; 89/191.01, 17, 1.1
See application file for complete search history.

(56) References Cited

U.S. PATENT DOCUMENTS

| | | | | |
|---|---|---|---|---|
| 7,775,150 | B2 * | 8/2010 | Hochstrate et al. | 89/193 |
| 7,937,870 | B2 * | 5/2011 | Brown | 42/16 |
| 7,938,055 | B2 * | 5/2011 | Hochstrate et al. | 89/193 |
| 8,051,595 | B2 * | 11/2011 | Hochstrate et al. | 42/75.01 |
| 8,117,958 | B2 * | 2/2012 | Hochstrate et al. | 89/193 |
| 8,141,285 | B2 * | 3/2012 | Brown | 42/71.01 |
| 8,156,854 | B2 * | 4/2012 | Brown | 89/1.4 |
| 8,210,089 | B2 * | 7/2012 | Brown | 89/191.02 |
| 8,210,090 | B2 * | 7/2012 | Brown | 89/193 |
| 8,234,808 | B2 * | 8/2012 | Lewis et al. | 42/73 |
| 8,393,102 | B2 * | 3/2013 | Brown | 42/6 |
| 8,393,103 | B2 * | 3/2013 | Brown | 42/16 |
| 8,505,433 | B2 * | 8/2013 | Hochstrate et al. | 89/193 |
| 8,549,982 | B2 * | 10/2013 | Troy et al. | 89/132 |
| 8,561,335 | B2 * | 10/2013 | Brown | 42/71.01 |
| 8,561,337 | B2 * | 10/2013 | Lewis et al. | 42/73 |

(Continued)

FOREIGN PATENT DOCUMENTS

WO WO 03095928 A2 * 11/2003

OTHER PUBLICATIONS

MRP Badness, Chapter 3, AR-15.com. (n.d.). AR-15-AR15.Com. Retrieved Jun. 16, 2014, from http://www.ar15.com/mobile/topic.html?b=3&f=12&t=509835&page=13.*

(Continued)

*Primary Examiner* — Jonathan C Weber
(74) *Attorney, Agent, or Firm* — Finch & Maloney PLLC

(57) ABSTRACT

Improvements and modifications in the rifle and submachine gun platforms to improve accuracy, improve user functionality, simplify and improve the machining and manufacturing and assembly process are presented. Specifically, the disclosure describes a hinge pin connection system for an access door, a retention mechanism that eliminates freedom of movement for hand guards, cuts in a barrel extension that reduce or eliminate barrel rotation, a barrel retention mechanism that allows for securing of a barrel from the sides of a firearm, a dove tail connection between an up rod and bolt carrier, and an aperture located on a lower receiver for mounting slings and other accessories.

16 Claims, 9 Drawing Sheets

(56) References Cited

U.S. PATENT DOCUMENTS

| | | | | |
|---|---|---|---|---|
| 8,640,372 | B2 * | 2/2014 | Hochstrate et al. | 42/75.01 |
| 8,713,833 | B2 * | 5/2014 | Lewis et al. | 42/16 |
| 2007/0033851 | A1 * | 2/2007 | Hochstrate et al. | 42/75.01 |
| 2007/0199435 | A1 * | 8/2007 | Hochstrate et al. | 89/191.02 |
| 2010/0300277 | A1 * | 12/2010 | Hochstrate et al. | 89/179 |
| 2011/0303082 | A1 * | 12/2011 | Hochstrate et al. | 89/193 |
| 2012/0111183 | A1 * | 5/2012 | Hochstrate et al. | 89/193 |
| 2013/0047832 | A1 * | 2/2013 | Hochstrate et al. | 89/191.01 |
| 2014/0041272 | A1 * | 2/2014 | Lewis et al. | 42/16 |
| 2014/0076152 | A1 * | 3/2014 | Hochstrate et al. | 89/193 |

OTHER PUBLICATIONS www.armslist.com, Copyright 2014, published by ListMill, May 22, 2014 (Colt 6920).

www.thescopesmith.com, The Scopesmith Rifle Accuracy Solutions, Copyright 2013, May 22, 2014 (Colt LE901).

http://www.armytimes.com/article/20090706/NEWS/907060307/Army-acquires-rights-M4, Cox, Matthew, "Army Acquires Rights to M4", Army Times, A Gannett Company, Jul. 6, 2009 (Colt ACC).

* cited by examiner

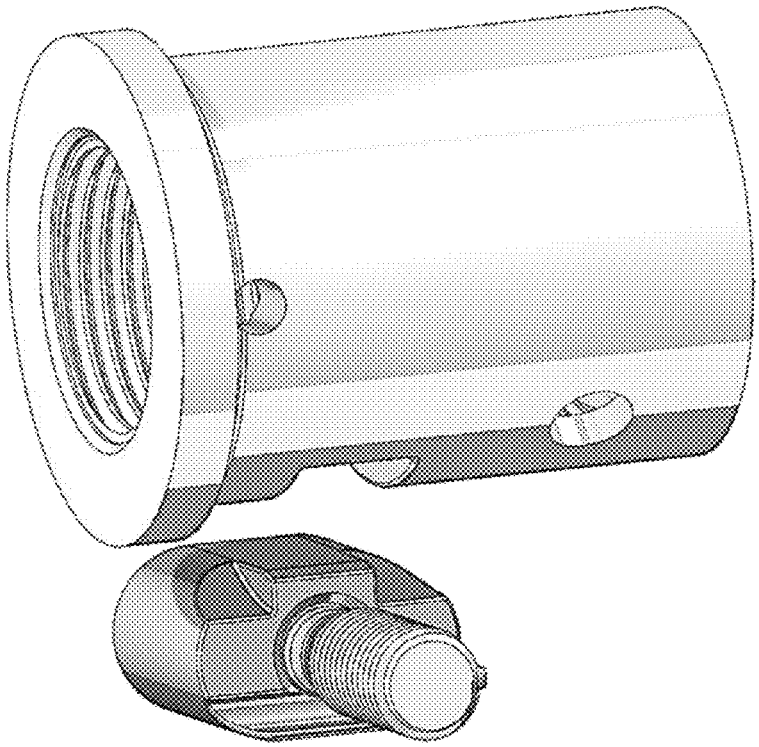
FIG. 13
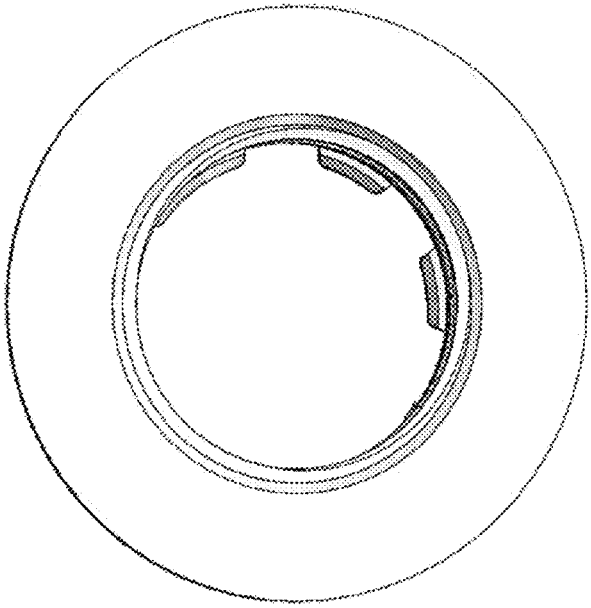
FIG. 14
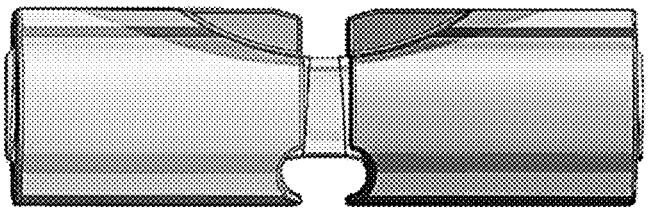

HINGE PIN CONNECTOR

RELATED APPLICATION

This application claims benefit of U.S. Provisional Patent Application Ser. No. 61/751,500, titled "RIFLE AND SUB-MACHINE GUN PLATFORMS" filed Jan. 11, 2013 and which is incorporated by reference in its entirety herein.

BACKGROUND

1. Field of Invention

The present disclosure relates to improvements and modifications in the rifle and submachine gun platforms and more particularly to a pin connect for an access door, a retention mechanism for hand guards, cuts in a barrel extension, a barrel retention mechanism, a dove tail connection between an up rod and bolt carrier, and an aperture located on a lower receiver.

2. Discussion of Related Art

The design, manufacture and assembly of firearms are often directed to improving the durability and reliability of the firearm. For example, components should be easily removable for cleaning or replacement while maintaining a high level of safety and durability. Designs are also often directed to adaptability so that a firearm can be used under a variety of conditions by users with different preferences. The adaptability of these firearms allows for a wide range of use among military, law enforcement, and civilians.

SUMMARY OF THE INVENTION

A number of improvements are described herein that are directed to improving the performance of firearms and to improvements in the manufacturing process. In one aspect, a method of securing a hinge pin to the receiver is provided. The hinge pin, which can be a hinge pin for an ejection port cover, can be secured by two or more tabs that can be formed integrally into the upper receiver. This avoids the need for secondary operations that may include drilling through portions of the receiver, shell deflector or forward assist assembly.

In another aspect, a method of securing the barrel to the receiver includes a turnbuckle type mechanism that can be used to secure the barrel by turning a single threaded rod. The use of this type of mechanism provides, among other functions, the ability to machine the receiver from either side, resulting in a more efficient production technique.

In another aspect, a hand guard is described in which a single forward screw is used to secure the hand guard to a firearm. The single screw can secure the hand guard and prevent both lateral and axial movement of the hand guard.

In another aspect, the barrel of a firearm includes one or more cuts or indentations that can be essentially parallel to each other. The cut or cuts can be used to secure and locate a barrel nut, creating a wedging effect and preventing barrel rotation.

In another aspect, an up rod is attached to a bolt carrier using a dovetail connection. A first end of the up rod includes a wedge shaped portion, and the wedge shaped portion and the up rod can be a singular piece of material. The connection mechanism is preferably a close-fitting connection that is readily assembled, but which prevents forward or backward movement at the connection area once assembled.

In another aspect, a through hole is provided in the lower receiver of a firearm. The through hole allows for ambidextrous attachment of slings and other accessories that might otherwise be limited to one side or the other.

As such, it is therefore an object of this invention to fulfill the existing need for multiple improvements in the design, manufacture, and assembly of various components within the rifle and submachine gun platforms, which may also be applicable to other firearms

DESCRIPTION OF THE DRAWINGS

These and other features and advantages of the present invention will be better understood by reading the following detailed description, taken together with the drawings wherein:

FIG. 13 is a detailed view of the barrel retention mechanism according to one embodiment of the present invention;

FIG. 14 is a detailed view of the barrel retention mechanism according to one embodiment of the present invention;

DETAILED DESCRIPTION

Traditional pin connections for access doors or ejection port covers on firearms have utilized a long access hole drilled from the front (or rear) portion of the firearm, thereby enabling a hinge pin to be slideably inserted through the opening in a direction parallel to the upper portion of the firearm, such that the hinge pin travels through the upper receiver and ejection port cover door until it reaches a stopping point. The drilling of this lengthy opening is time consuming and the insertion of the hinge pin can be hindered by the various components located at the insertion area. This configuration also makes it difficult to remove the ejection port cover without first removing other components.

Figure 1:
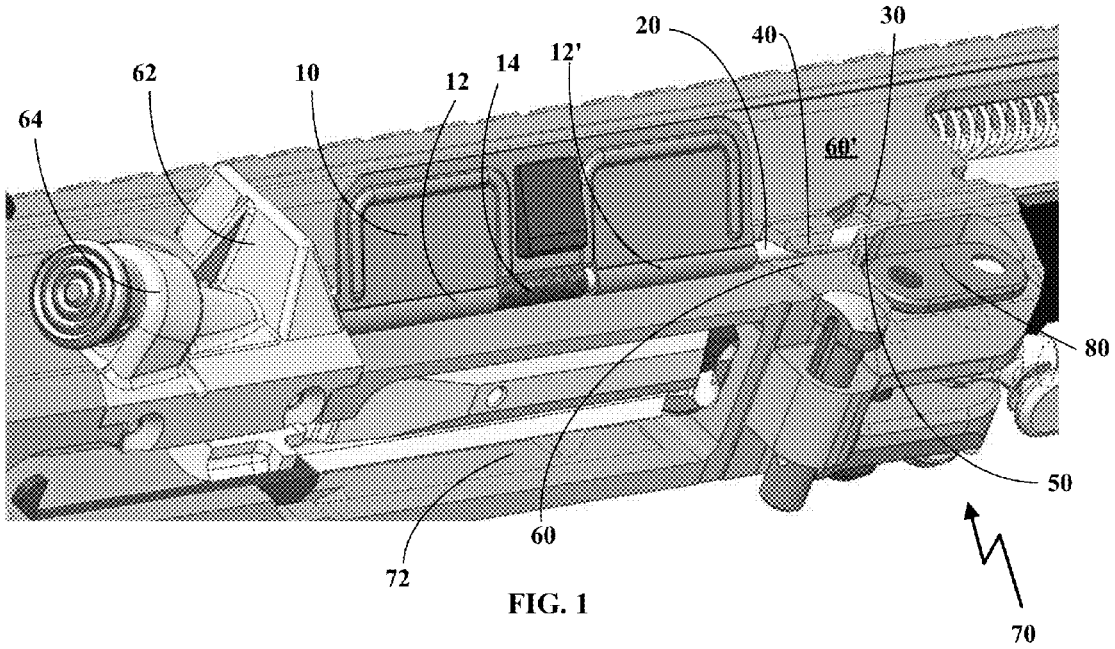
FIG. 1 is a detailed view of the pin connection for an access door hinge pin according to one embodiment of the present invention.
Figure 2:
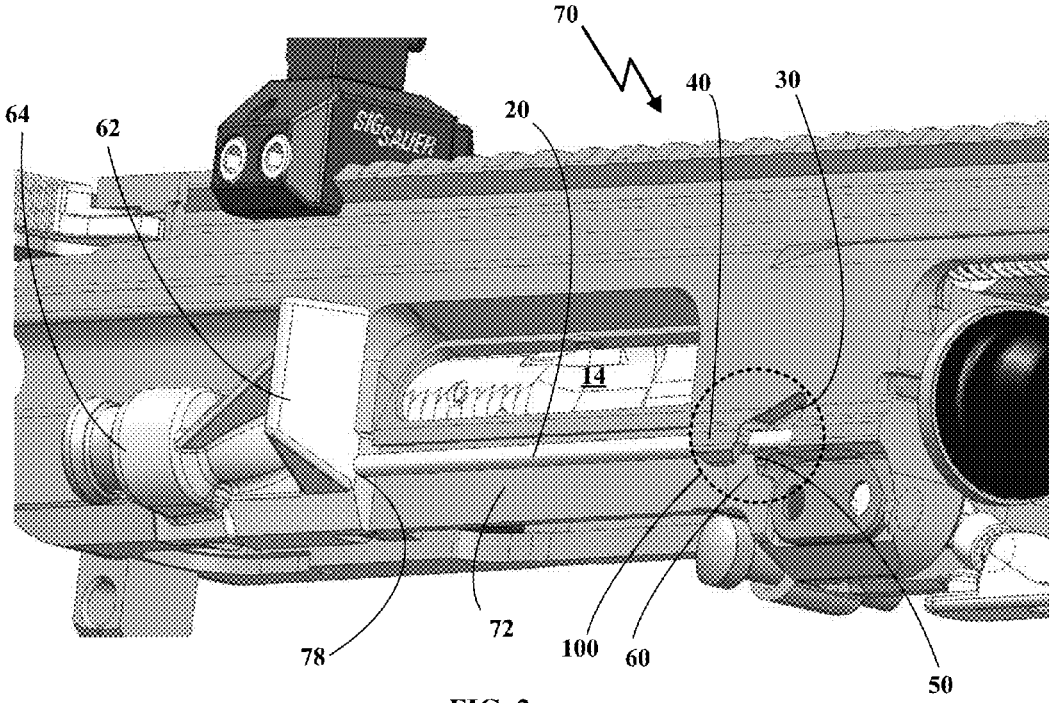
FIG. 2 is a detailed view of the pin connection for an access door hinge pin according to one embodiment of the present invention.
Figure 3:
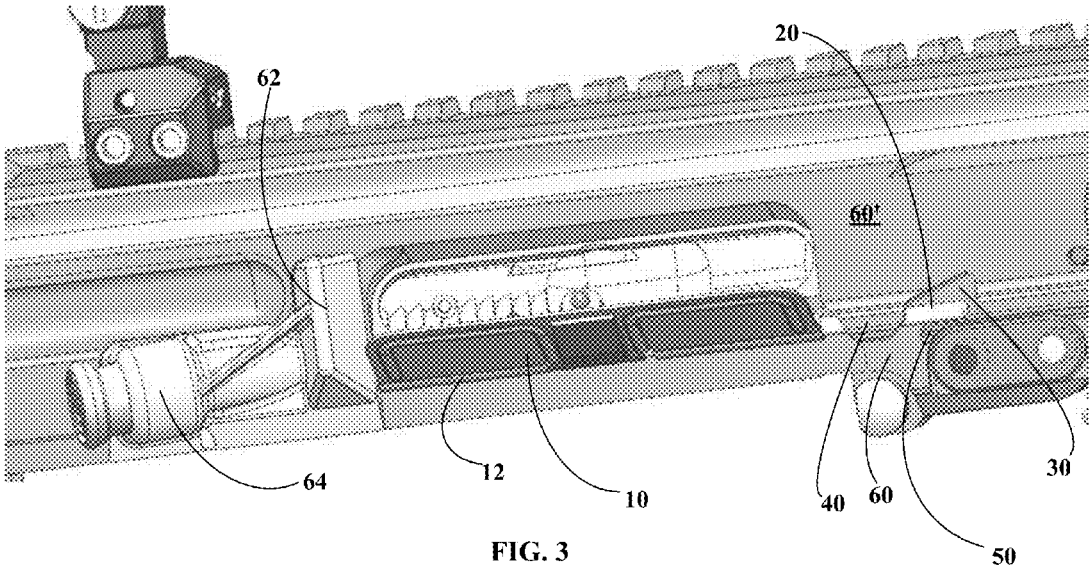
FIG. 3 is a detailed view of the pin connection for an access door according to one embodiment of the present invention.

In one embodiment illustrated in FIGS. 1-3 a pin connector or retention mechanism 100 (FIG. 2 dashed circle) is disclosed that allows for the secure insertion of a hinge pin while eliminating the need for a lengthy bore forward or rear of the ejection port cover. The retention mechanism allows the hinge pin to be slid in from a position outside the ejection port via a sliding and capturing movement. In different embodiments, some of the connector components or all of the connector components can be integral to the receiver, such as upper receiver 70. Two parts are integral if they are formed from a common monolith and are not attached to each other in a subsequent manufacturing step. In some embodiments, the connector components can be machined into the receiver during the same milling process that is used to form other components in the receiver, such as, for example, the ejection port. This can save time and reduce the number of processes required to form a hinge pin connector.

In the embodiment illustrated, connector 100 is positioned directly adjacent to the ejection port cover and includes insertion area 30, shelf member 50, and containing member 40. As illustrated in FIGS. 1-3, the muzzle of the firearm is to the right and is referred to herein as the forward end of the firearm. In the embodiment shown, each of the components making up the connector is integral to upper receiver 70, and each is configured to allow entry and retention of an end of hinge pin 20. As shown, insertion area 30 is a space that is defined by shelf member 50, containing member 40, and two planes (that may be parallel to each other) made by upper receiver outer surface 60 and upper receiver outer surface 60'. Shelf member 50 is located just above barrel clamp 80 and provides upward vertical support (oriented as the firearm is typically held in a horizontal position) to hinge pin 20, preventing the downward movement of hinge pin 20 when it is installed. As shown in the figures, an end of hinge pin 20 is in contact with shelf member 50.

Containing member 40 is located to the rear of and above shelf member 50. As illustrated, it is not aligned vertically with shelf member 50. In other embodiments, containing member 40 may be positioned forward of and/or below shelf member 50. In the embodiment shown, a slot is formed between shelf member 40 and outer surface 60 of upper receiver 70. When viewed as an axial cross-section (e.g., see FIG. 7) the slot can be in the shape of an inverted U. At least a portion of the slot may have a width that is substantially (within 10%) equivalent to the diameter of hinge pin 20. In some embodiments, the lower lip of containing member 40 may curve inwardly or outwardly so that the inverted U may have a smaller or larger width at the opening than at a point above the opening. The width at the opening may be equal to or smaller than the diameter of hinge pin 20 so that some force is required to push hinge pin 20 past the lip. In other embodiments, a wider opening can provide for easier insertion of hinge pin 20 and the forward end of hinge pin 20 can be vertically supported exclusively by shelf member 50. Containing member 40 serves to restrict hinge pin 20 laterally and can prevent hinge pin 20 from moving in a direction away from upper receiver 70. In this configuration, one end of the hinge pin rests on shelf member 50 and in insertion area 30, and the opposite end of the hinge pin contacts a component of the firearm that is to the rear of ejection port 14. This component may be, for example, forward assist assembly 64 or shell deflector 62, as shown. The shell deflector or forward assist assembly may include a cavity 78 that is configured to receive one end of hinge pin 20. Cavity 78 can be, for example, a bore or a depression.

In one aspect, a method of securing a hinge pin and installing a cover is provided. In one set of embodiments, the cover is an ejection port cover and the hinge pin is the ejection port cover hinge pin. In one embodiment, hinge pin 20 can be attached to ejection port cover 10 by threading hinge pin 20 through hinge knuckles 12 and 12' and spring 14 prior to connecting hinge pin 20 to connector 100. Either end of hinge pin 20 can be inserted first, or both ends can be inserted simultaneously. For example, in one embodiment, the rear end of hinge pin 20 is first inserted into cavity 78 on shell deflector 62. With ejection port cover 10 threaded on the hinge pin, the forward end of hinge pin 20 can then be pivoted upwardly into connector 100 by manually pushing hinge pin 20 upwardly into the invented U-shaped slot defined by containing member 40. The hinge pin can then be shifted forward so that the forward end of hinge pin 20 is supported by shelf member 50. The ejection door assembly, including the hinge pin, is then fully installed and will stay in position during typically use. For cleaning or replacement, the ejection port door can be easily removed by reversing the steps used to install the assembly. In some cases, hinge pin 20 can be flexed slightly to shorten its effective length.

In another embodiment, the forward end of hinge pin 20 can be inserted first. The free standing hinge pin, which may or may not already be threaded onto hinge knuckles 12 and 12', can be inserted into insertion area 30 by sliding the forward end of hinge pin 20 upwardly into the insertion area at approximately a 45 degree angle to vertical. Once the forward end is in insertion area 30, the rear end of the hinge pin is then pushed upwardly, raising the hinge pin to horizontal. As the hinge pin is raised, the forward end of the hinge pin uses shelf member 50 as a fulcrum, and the hinge pin is pushed under containing member 40. Once the hinge pin reaches horizontal, it can be fully cantilevered via connector 100 or can be slid backward into cavity 78 and supported at both ends. In either case, the hinge pin is securely retained in position and can be removed by reversing the installation steps.

In another aspect, software is provided that is capable of instructing a milling machine to cut the connector components into the receiver. For example, a non-transient computer program product having instructions encoded thereon that when executed by one or more processors cause a process to be carried out, the process comprising forming a connector on the outer surface of the upper receiver, the connector including a shelf member, a containing member and an insertion area.

Figure 4:
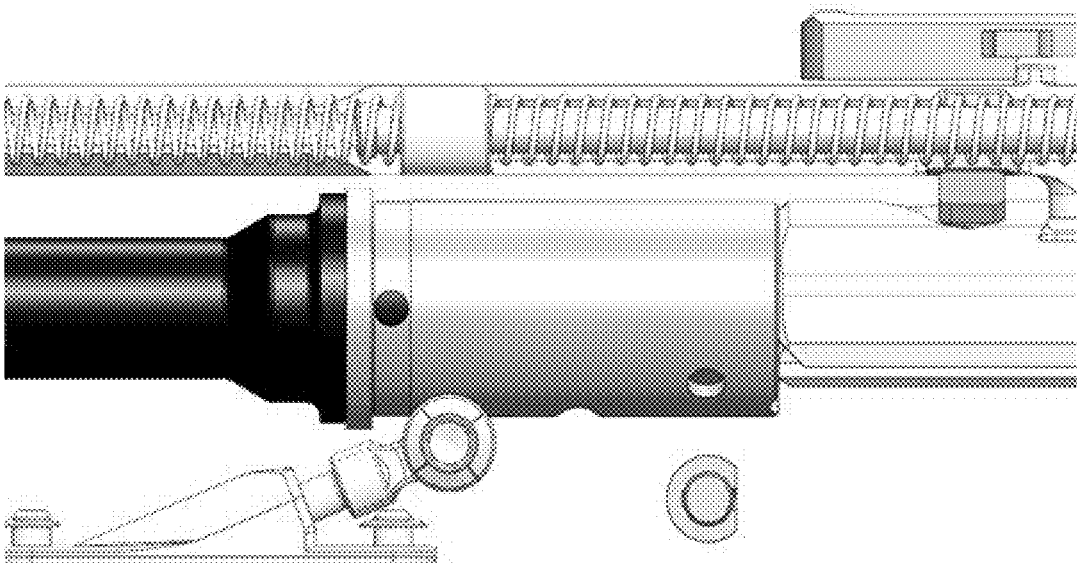
FIG. 4 is a detailed view of the cuts in the barrel extension according to one embodiment of the present invention.

In another aspect, illustrated in FIG. 4, at least one cut or indentation is machined into an external surface of a barrel extension. In one embodiment, there will be a first cut and a second cut, which are preferably essentially parallel to one another and of similar depth and length, although variations in the depth and length of the first and second cuts are contemplated and within the scope of the present invention. At least one cut is configured to accept at least a portion of a shaft surface of a screw or barrel nut. The cut is configured to secure and locate the barrel nut, thereby creating a wedging effect and preventing barrel rotation. In a preferred embodiment, two barrel nuts are employed, with a portion of the shaft surface of each barrel nut resting against each cut, respectively. One of the barrel nuts may also be configured to accept a front clamping screw or a hand guard clamp screw.

Figure 5:
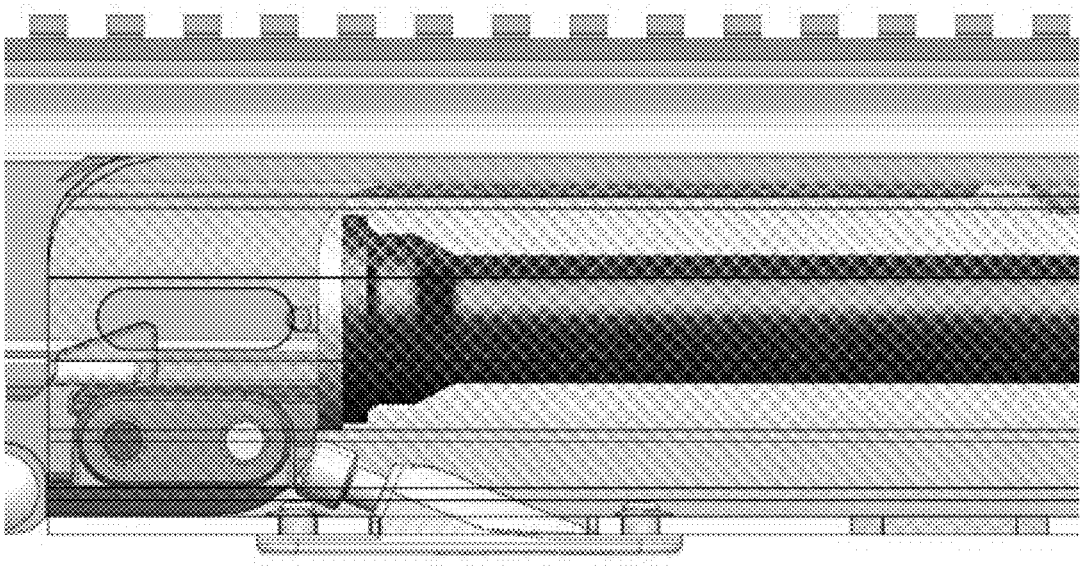
FIG. 5 is a detailed view of the retention mechanism for hand guards according to one embodiment of the present invention.
Figure 6:
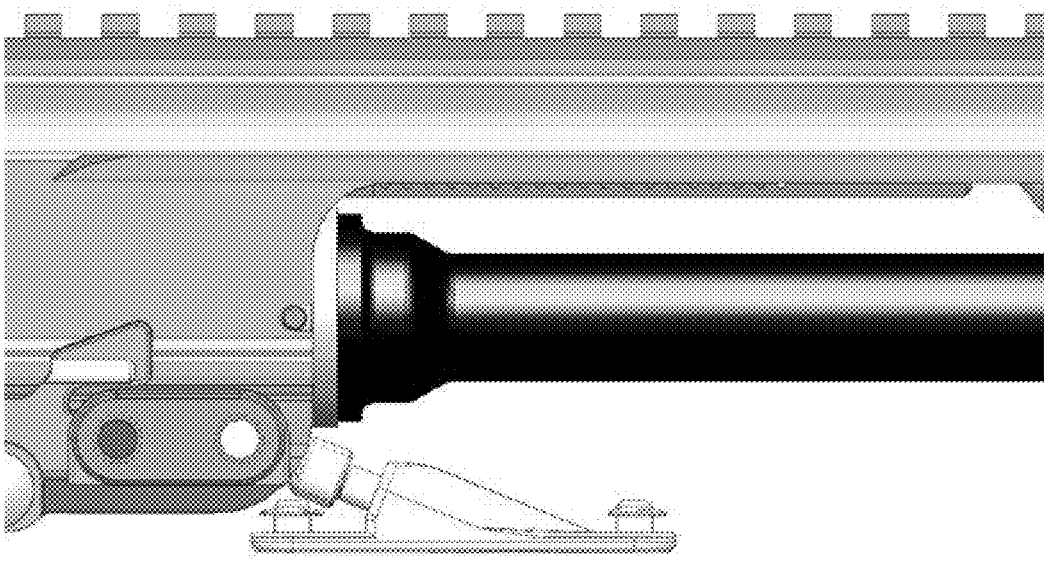
FIG. 6 is a detailed view of the retention mechanism for hand guards according to one embodiment of the present invention.
Figure 7:
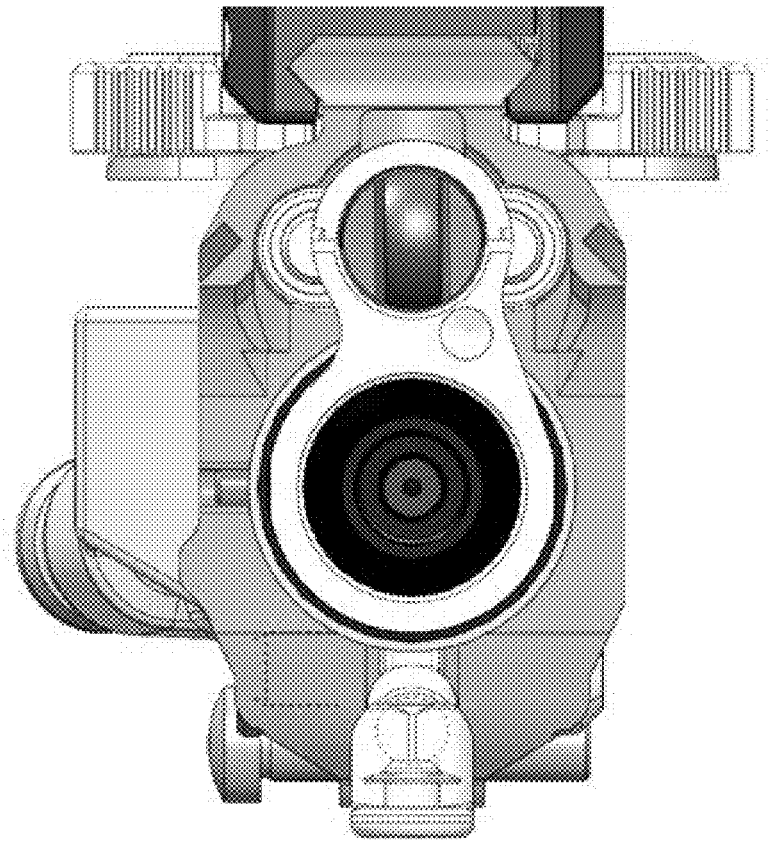
FIG. 7 is a detailed view of the retention mechanism for hand guards according to one embodiment of the present invention.
Figure 8:
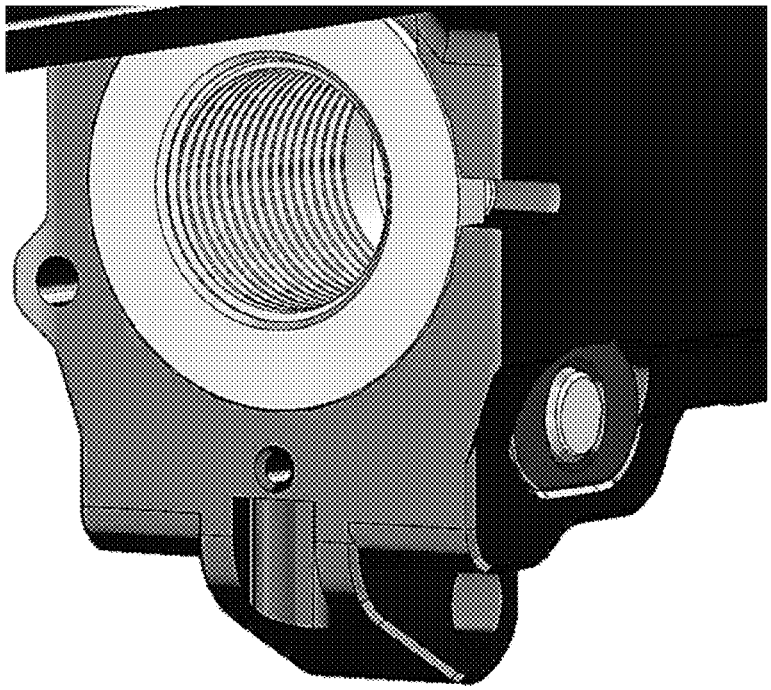
FIG. 8 is a detailed view of the barrel retention mechanism according to one embodiment of the present invention.
Figure 9:
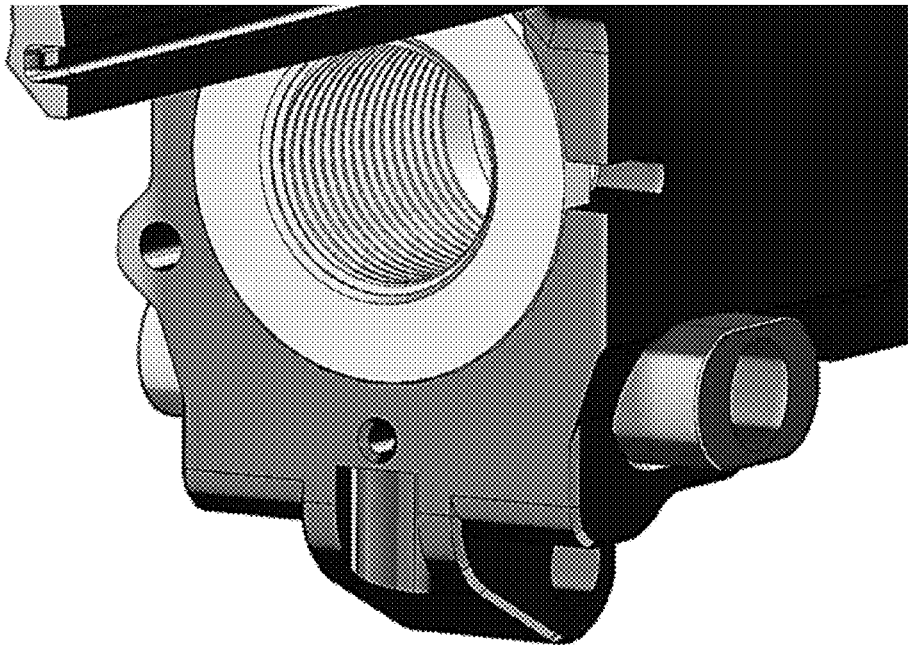
FIG. 9 is a detailed view of the barrel retention mechanism according to one embodiment of the present invention.
Figure 10:
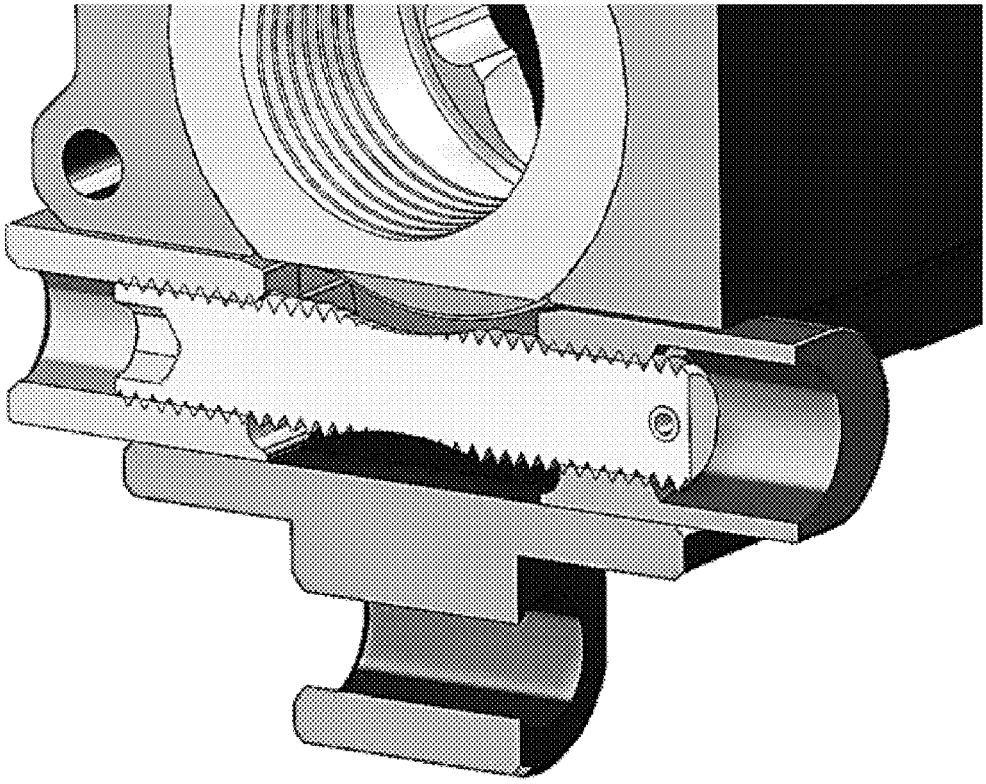
FIG. 10 is a detailed view of the barrel retention mechanism according to one embodiment of the present invention.
Figure 11:
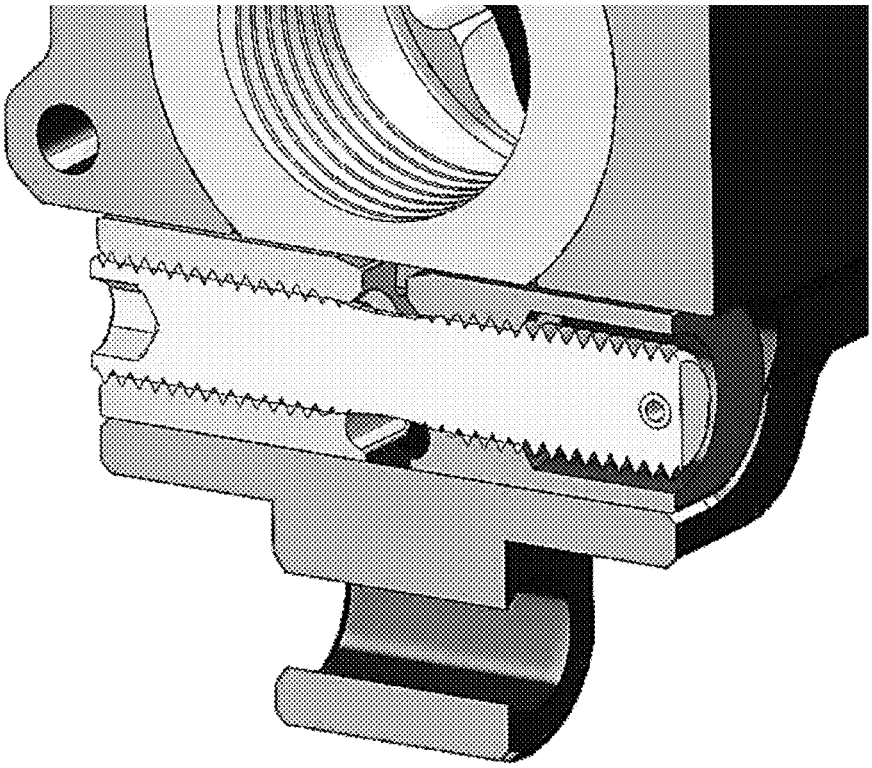
FIG. 11 is a detailed view of the barrel retention mechanism according to one embodiment of the present invention.
Figure 12:
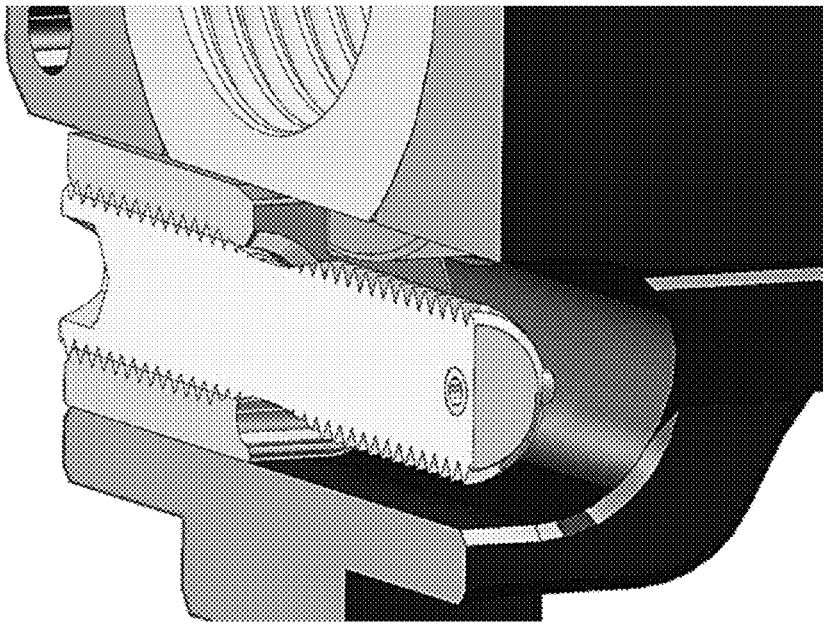
FIG. 12 is a detailed view of the barrel retention mechanism according to one embodiment of the present invention.

The front clamping screw or hand guard clamp screw is the only mechanism needed to hold the hand guard in position, FIGS. 5-7, according to another embodiment of the present invention. The clamping screw is a retention mechanism for a hand guard. The clamping screw eliminates freedom of movement, providing upward and backward tension that locks the hand guard in place. As the screw is tightened, the hand guard is pressed into position. The hand guard may be a one piece or a multiple piece unit. In a preferred embodiment, the hand guard is a one piece design that features an opening that runs along the length of the hand guard, wherein a first side of the opening is configured to engage with a first rail and a second side of the opening is configured to engage with a second rail. It is contemplated and within the scope of the present invention that the system may employ two or more front clamping screws, depending on the type, size and weight of the firearm.

In a further embodiment of the present invention, the firearm features a barrel retention mechanism or barrel lock that is configured to work like a turn buckle. The barrel retention mechanism includes a first end with right-handed threads and a second end with left-handed threads. The barrel retention mechanism allows for the ability to machine from the sides of the firearm. In this way, the barrel retention mechanism is located in a position perpendicular to the barrel. The barrel retention mechanism is threaded through a housing and serves to engage and secure the barrel.

Figure 15:
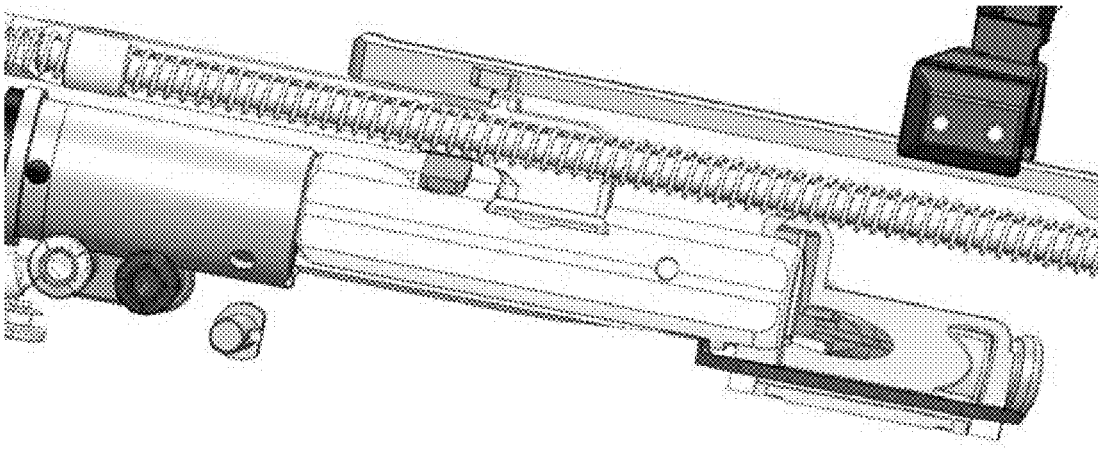
FIG. 15 is a detailed view of the dovetail connection between the rod and bolt carrier according to one embodiment of the present invention.
Figure 16:
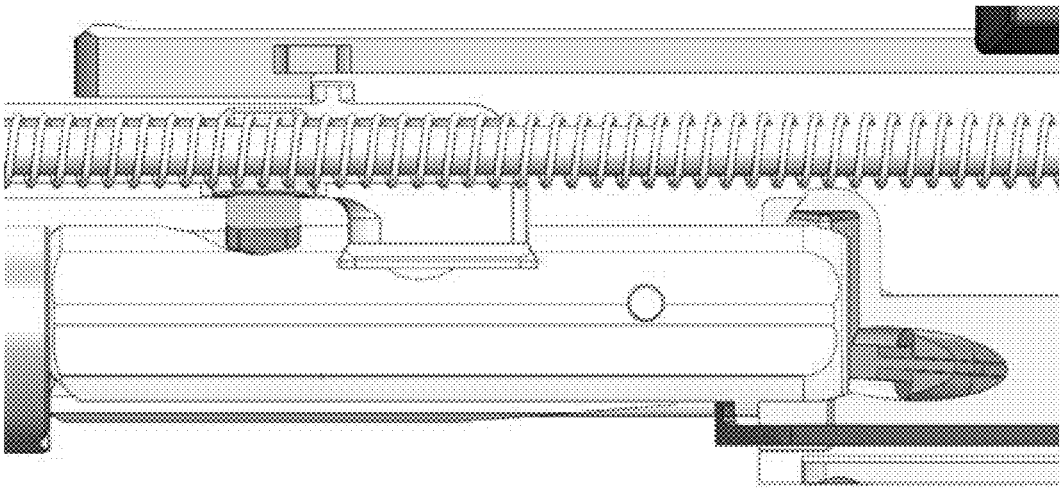
FIG. 16 is a detailed view of the dovetail connection between the rod and bolt carrier according to one embodiment of the present invention.

In another embodiment of the present invention, shown in FIGS. 15 and 16, an up rod attaches to a bolt carrier. A first end of the up rod includes a wedge shaped portion, preferably requiring that the wedge shaped portion and the up rod are a singular piece of material. The wedge shaped portion includes two flared portions and a recessable pin located on a lower surface. The bolt carrier includes a channel with two indentations and an aperture located on a bottom surface of the channel. The wedge shaped portion is configured to slide over the channel from the side, such that a user would depress the recessable pin and then move the wedge shaped portion of the up rod into the channel. The two flared portions are configured to form a restricting connection with the indentations of the channel. Once the user begins to slide the wedge into the channel, the bottom surface of the channel will hold the recessable pin in an upward position. Once the recessable pin aligns with the aperture, the recessable pin will release and lock into the aperture, thereby restricting further movement of the wedge of the up rod within the channel of the bolt carrier. When the up rod and bolt carrier are effected during discharge of the firearm, the dovetail connection created by the wedge shaped portion on the up rod and the channel on the bolt carrier generates a durable connection.

Figure 17:
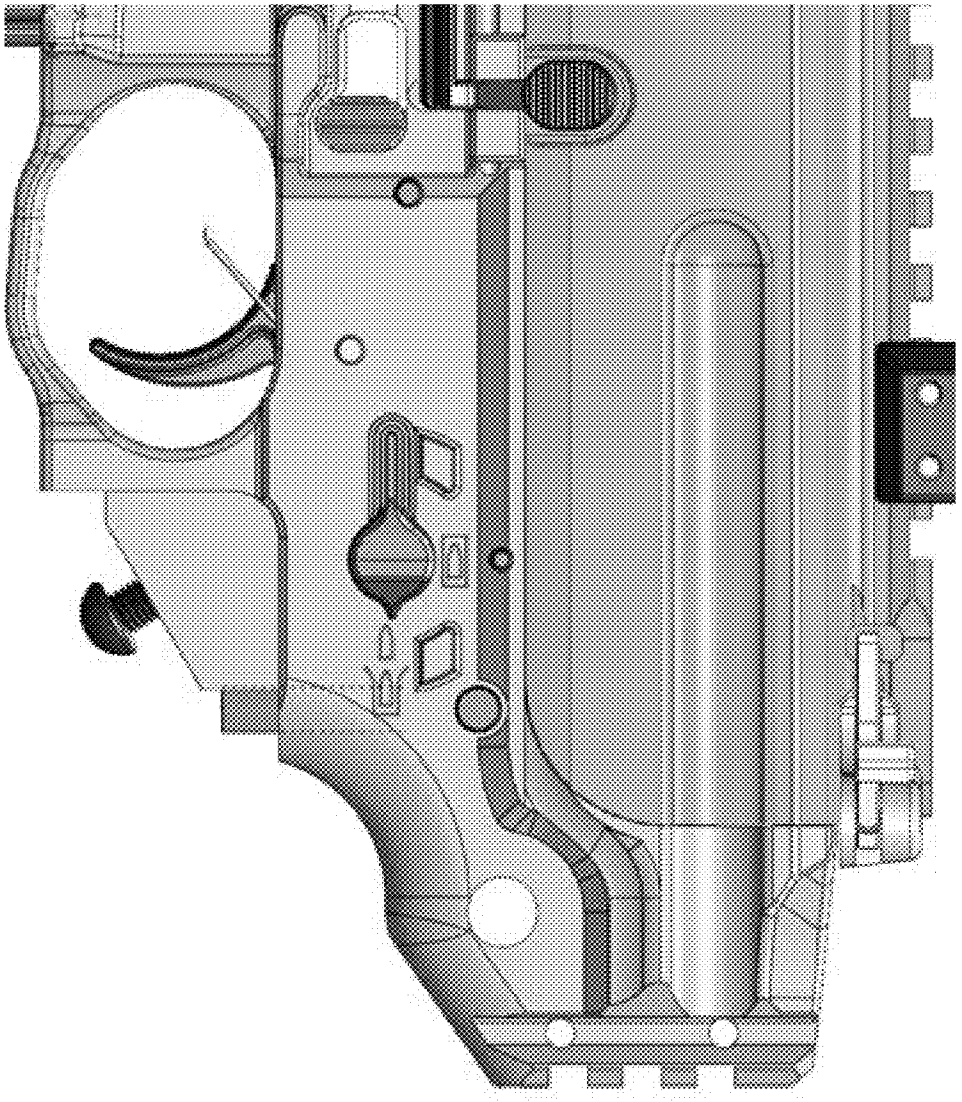
FIG. 17 is a detailed view of the aperture located on the lower receiver according to one embodiment of the present invention.

In a final embodiment of the present invention, illustrated in FIG. 17, a through-hole is created in the lower receiver. The through-hole is preferably located in a portion of the lower receiver that is directly above and behind the pistol grip of the firearm, although it is contemplated and within the scope of the present invention that the location of the through-hole could be at other locations on the firearm. The through-hole is designed to allow for ambidextrous attachment of accessories, such as a sling. Prior art configurations have featured an aperture on both sides, but not one that went entirely through the lower receiver. The through-hole enables mounting of a sling with QD mounts as well as a reversible insertion for a sling or other accessories.

It is understood that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention and not to be limited except by the allowed claims and their legal equivalents.

What is claimed is:

1. A hinge pin connector for a firearm, the hinge pin connector comprising:

a shelf member integral with and extending from an outer surface of a firearm receiver and positioned on a first side of an ejection port in a direction parallel to a firing axis of the firearm;

a containing member spaced apart from the shelf member and positioned on the first side of the ejection port in the direction parallel to the firing axis, the containing member integral with the receiver and extending from the outer surface of the receiver to define a longitudinal slot between the containing member and the receiver surface, the slot aligned with the axis of the firearm and having a cross dimension in at least one direction that is approximately equal to the diameter of a hinge pin to be secured in the connector;

an insertion area positioned between the shelf member and the containing member and positioned on the first side of the ejection port in the direction parallel to the firing axis, the insertion area constructed and arranged to receive the hinge pin in an angled orientation with respect to the axis of the firearm and to allow pivoting of the hinge pin to a position substantially parallel with the axis of the firearm where the shelf member, the containing member, and the surface of the receiver block lateral movement of the hinge pin away from the receiver; and a receptacle positioned on a second side of the ejection port, opposite to the first side in the direction parallel to the firing axis, and constructed and arranged to receive a portion of the hinge pin and to block the hinge pin from pivoting away from the firearm receiver.

2. The hinge pin connector of claim 1 wherein the shelf member is substantially horizontal and positioned forward of the containing member.

3. The hinge pin connector of claim 1 wherein the containing member extends downwardly and the slot is bounded by an upper surface defined by the containing member, the upper surface positioned above the substantially horizontal surface of the shelf member by a dimension approximately equal to the diameter of the hinge pin.

4. The hinge pin connector of claim 1 further comprising a forward assist assembly or a shell deflector wherein the receptacle is formed in the forward assist assembly or shell deflector.

5. The hinge pin connector of claim 4 wherein the hinge pin is secured by three points of contact including the shelf member, the containing member and either the forward assist assembly or the shell deflector.

6. The hinge pin connector of claim 1 wherein the containing member and the shelf member are positioned forward of the ejection port.

7. The hinge pin connector of claim 1 wherein the shelf member is located directly above a barrel clamp.

8. A method of retaining a hinge pin in a firearm, the method comprising:

placing a first end of the hinge pin in a bore positioned behind an ejection port;

pivoting a second end of the hinge pin into a position parallel with a firing axis of the firearm;

pushing the second end of the hinge pin under a containing member that is integral to the firearm; and securing the pin against three points of contact including the bore that is behind the ejection port, the containing member that is forward of the ejection port and a shelf member that is forward of ejection port and spaced apart from the containing member in a direction parallel to the firing axis.

9. The method of claim 8 further comprising threading the hinge pin through a knuckle of an ejection port cover prior to pushing the second end of the hinge pin under the containing member.

10. The method of claim 8 further comprising removing the ejection port cover by pulling the second end of the hinge pin out from the containing member to disconnect the hinge pin and ejection port cover assembly from the firearm.

11. The method of claim 8 comprising shifting the hinge pin forward after pushing the hinge pin under the containing member.

12. A method of securing a hinge pin to a firearm, the method comprising:

positioning a first end portion of a hinge pin in an insertion area between a containing member and a fulcrum that is spaced apart from the containing member along a firing axis of the firearm, the hinge pin in an angled orientation with respect to the firing axis and each of the containing member and fulcrum being integral with a receiver of the firearm;

pivoting the hinge pin against the fulcrum toward an orientation that is parallel to the firing axis of the firearm; and moving the first end portion of the hinge pin into a slot behind the containing member and aligning a second end portion of the hinge pin with a receptacle in the firearm to block movement of the hinge pin laterally away from the firearm.

13. The method of claim 12 comprising passing the hinge pin through a hinge knuckle on an ejection port cover prior to pivoting the hinge pin.

14. The method of claim 12 further comprising removing the hinge pin by pivoting a second end portion of the hinge pin from the orientation that is parallel to the firing axis until the hinge pin clears the containing member.

15. The method of claim 12 wherein the receptacle is a bore in either a shell deflector or a forward assist assembly of the firearm.

16. The method of claim 12 wherein the hinge pin is prevented from moving axially and rotationally by being in contact with the shelf member, the containing member and the side of the upper receiver.

* * * * *